US007736451B2

(12) United States Patent
Kaneko

(10) Patent No.: US 7,736,451 B2
(45) Date of Patent: Jun. 15, 2010

(54) ALUMINUM ALLOY PIPE AND METHOD OF MANUFACTURING SAME

(75) Inventor: Ryuichi Kaneko, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 835 days.

(21) Appl. No.: 11/099,701

(22) Filed: Apr. 6, 2005

(65) Prior Publication Data

US 2005/0230015 A1 Oct. 20, 2005

(30) Foreign Application Priority Data

Apr. 16, 2004 (JP) ..... 2004-121354

(51) Int. Cl.
*C22F 1/04* (2006.01)

(52) U.S. Cl. ..... 148/690; 148/694; 148/688; 148/698

(58) Field of Classification Search ..... 148/690, 148/694, 698, 688
See application file for complete search history.

(56) References Cited

U.S. PATENT DOCUMENTS 5,951,794 A * 9/1999 Dickson, Jr. ..... 148/690
2003/0046803 A1* 3/2003 Kaneko ..... 29/515

FOREIGN PATENT DOCUMENTS

JP 2-143293 12/1990
JP 10168553 A * 6/1998
KR 2002-0036111 5/2002

* cited by examiner

*Primary Examiner*—Roy King
*Assistant Examiner*—Caitlin Fogarty
(74) *Attorney, Agent, or Firm*—Rabin & Berdo, P.C.

(57) ABSTRACT

A first step of performing solution treatment to a pipe material of a precipitation-hardening type aluminum alloy of high hardness extruded, a second step of performing spinning work to the solution-treated pipe material, and a third step of performing artificial aging to the spinning-worked pipe material.

6 Claims, 4 Drawing Sheets

ALUMINUM ALLOY PIPE AND METHOD OF MANUFACTURING SAME

BACKGROUND OF THE INVENTION

1. Field of the Invention

The present invention relates to a method of manufacturing an aluminum alloy pipe of high strength, and in particular to a method suitable for manufacturing a front-fork outer tube for a two-wheeled vehicle.

2. The Related Art of the Invention

Japanese Unexamined Utility Model Publication No. 2-143293 has disclosed as one method of manufacturing a front-fork outer tube for a two-wheeled vehicle using an aluminum alloy pipe of high strength such as an Al—Zn—Mg family aluminum alloy or an Al—Zn—Mg—Cu family aluminum alloy a method of cutting an aluminum pipe of high strength after age-hardening.

FIG. 10 shows the processes of this manufacturing method. A pipe according to the manufacturing method is manufactured by the order of the following processes:

(1) The process of performing solution treatment by heating a pipe (referred to as solution process 1 hereinafter as needed), (2) The process of performing mill treatment by milling the pipe (referred to as mill process 2 hereinafter as needed), (3) The process of performing artificial aging treatment by reheating the pipe (referred to as artificial aging process 3 hereinafter as needed), and (4) The process of performing cutting treatment necessary for the pipe (referred to as cutting treatment 4 hereinafter as needed).

And there is another method of manufacturing a pipe by the processes shown in FIG. 11. Namely a pipe is manufactured by the order of the following processes.

(1) The process of performing softening treatment by heating a pipe to a temperature within a certain range (referred to as softening process 5 as needed), (2) The process of performing plastic working treatment to the pipe (referred to as plastic working process 6 hereinafter as needed), (3) Solution process 1 of performing solution treatment 1.

(4) Artificial treatment process 3 of performing artificial aging treatment, and (5) Cutting process 4 of performing cutting work treatment.

Forming the outer tube of the front fork for a motor bike by the above-described methods allows light in weight of an entirety of a pipe material and establishment of strength of a part of the pipe material.

SUMMARY OF THE INVENTION

The manufacturing method shown in FIG. 10, however, has the following problems. Wasteful materials increase due to an increase in weight in the materials. The cutting time increases. The expenses for dealing with chips produced in cutting work increase. The mill treatment does not produce great reduction and it is difficult to provide an increase in strength by work hardening. Therefore, Materials of high strength are required, which increases a material unit price.

And the manufacturing method shown in FIG. 11 has the following problems. A material prior to solution treatment is brittle, which makes it impossible to provide the material with plastic deformation. As a result, the softening process is necessary, causing an increase in the number of the processes. Performing the solution treatment at a high temperature causes distortions in the material and it is required to increase cutting portions of the material in cutting work. Since work hardening is not used due to no plastic working after the solution treatment, the material of high strength is necessary, which increases a material unit price. Artificial aging time is long and therefore expenses for heat treatment become high.

In view of the above, there exists a need for a method of manufacturing an aluminum alloy pipe which overcomes the above-mentioned problems in the related art. The present invention addresses this need in the related art as well as other needs, which will become apparent to those skilled in the art from this disclosure.

It is an object of the present invention to provide a method of manufacturing an aluminum alloy pipe for a relatively short time without an increase in the number of work processes, using an inexpensive material.

In order to achieve above the objects the invention provides a method of manufacturing an aluminum alloy of high strength. The method comprises a steps of providing a pipe material formed of a precipitation-hardening aluminum alloy of high hardness extruded, performing solution treatment to the pipe material by heating the pipe material to a temperature within a predetermined range, performing spinning work treatment to the solution-treated pipe material by pressing a roller on an outer periphery of the solution-treated pipe material while rotated, and performing artificial aging treatment to the spinning-worked pipe material by heating the spinning-worked pipe material to a temperature within a predetermined range lower than the temperature in the solution treatment.

The invention also provides an aluminum alloy pipe of high strength. The pipe comprises a pipe material of a precipitation-hardening aluminum alloy of high hardness extruded, wherein solution treatment is performed to the pipe material by heating the pipe material to a temperature within a predetermined range, spinning work is performed to the pipe material by pressing a roller on an outer periphery of the solution-treated pipe material while rotated, and artificial aging treatment is performed to the spinning-worked pipe material by heating the spinning-worked pipe material to a predetermined temperature lower than in the solution step, so that the aluminum alloy of high strength is provided, and an outer side face and an inner side face of the aluminum alloy pipe after the artificial aging treatment is performed thereto are nearly even in hardness, and the outer side face of the aluminum alloy pipe is in an excessive aging state.

These and other objects, features, aspects and advantages of the present invention will be become apparent to those skilled in the art from the following detailed description, which, taken in conjunction with the annexed drawings, discloses preferred embodiments of the present invention.

BRIEF DESCRIPTION OF THE DRAWINGS

Preferred embodiments according to the invention will be explained below referring to the drawings, wherein.

DETAILED DESCRIPTION OF THE PREFERRED EMBODIMENTS

The selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Preferred embodiments of the present invention will be explained with reference to the drawings.

Figure 1:
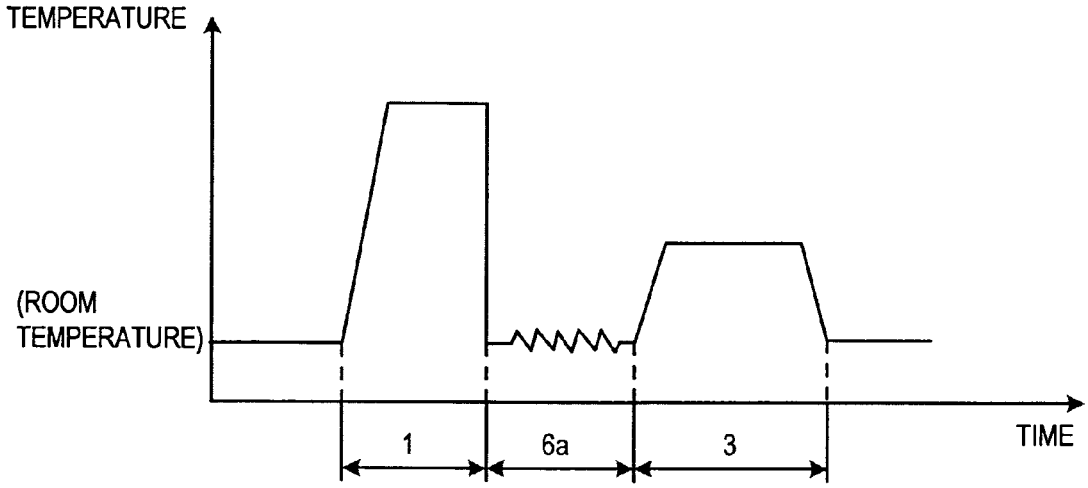
FIG. 1 is an explanatory view showing a method of manufacturing an aluminum alloy pipe in a first preferred embodiment of the present invention.

FIG. 1 is a process explanatory view with respect to a method of manufacturing an aluminum alloy pipe in a first preferred embodiment of the present invention.

A precipitation-hardening type of aluminum alloy of high hardness is used as a material of an aluminum alloy material in the present invention. An A7000 family aluminum alloy (especially, an aluminum ally of Al—Zn—Mg family or Al—Zn—Mg—Cu family) is used as one example thereof. The A7000 family aluminum alloy is a material having properties of high strength and small extension corresponding thereto. The A7000 family aluminum alloy is beforehand extruded to be formed as a precipitation-hardening type of aluminum alloy pipe of high hardness.

First, a solution process 1 of performing solution treatment to a pipe material (referred to as just a pipe hereinafter as needed) formed of the precipitation-hardening type of the aluminum alloy pipe of high hardening by heating it is performed. An optimum value in temperature for the solution treatment is preferably in the range of 450° C.-500° C.

After the solution process 1, the pipe material is rapidly cooled so that the temperature is back to a room temperature and then the spinning work process 6*a* is performed.

Figure 5:
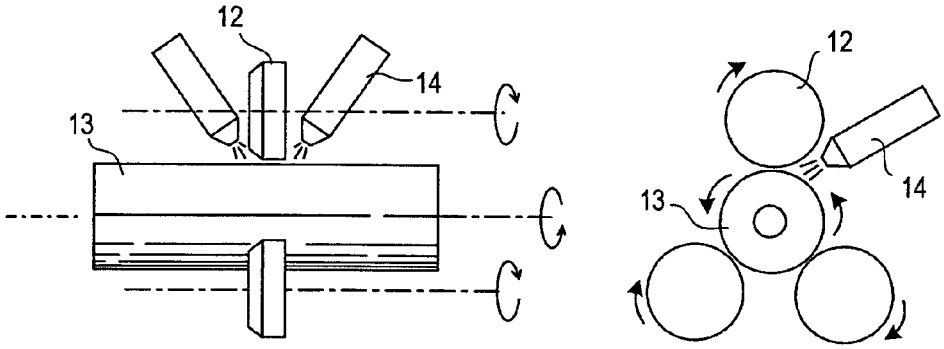
FIG. 5 is an explanatory view showing a spinning work process in the first preferred embodiment.

FIG. 5 shows a spinning work process 6*a* which is a work method where a roller 12 is pressed in three directions against an outer periphery of the material 13 with the material 13 rotated around the axis and simultaneously the material 13 is moved in the axial direction, which therefore, forms a predetermined outer diameter of the material 13 while extending it in the axial direction.

A thickness and an outer diameter of the pipe material 13 are varied by a pressing amount of the roller 12. Distortions generated in an inside of the pipe material 13 can be varied in size by working degrees of the pipe material 13.

With regard to the roller 12 in the figure, in the case of sending the roller 12 in the axial direction only, the roller 12 with only one face thereof tapered is used and on the other hand, in the case of processing the pipe material 13 while reciprocating it in the axial direction, the roller 12 with both faces tapered may be used. The pipe material 13 is supported by a main shaft (not shown), and may be rotated either by rotation of the roller 12 or by rotation of the main shaft, and the pipe material 13 may be moved in the axial direction or the roller 12 may be moved in the axial direction of the pipe material 13.

This spinning work is an effective work method in a case the thickness of the pipe material 13 is varied in any position of the axial direction, thereby providing a single, integral pipe material 13 with a portion having strength capability and a portion having extension capability.

And speeding up rotation of the main shaft causes an increase in heat generation amount per time, namely in friction heat between the roller 12 and the pipe material 13, and in heat generated by material deformation, thereby allowing warm work without a heat source.

In the spinning work process 6*a*, a temperature of the pipe material 13 of high heat conductivity made of aluminum is properly controlled by spraying a coolant to the pipe material 13 by a nozzle 14 provided in each side of the roller 12.

Note that in FIG. 1, a process of natural aging (natural heat release) may be provided between the solution process 1 and the spinning work process 6*a*.

After the spinning work process 6*a* ends, the pipe material 13 formed in a predetermined dimension and shape is moved to the process 3 of the artificial aging treatment (the artificial aging process). This artificial aging is a process for maintaining temperatures within a predetermined range. In this case it is preferable to heat and maintain the pipe material 13 at temperatures in the range of 100° C.-190° C. for the optimum.

Figure 2:
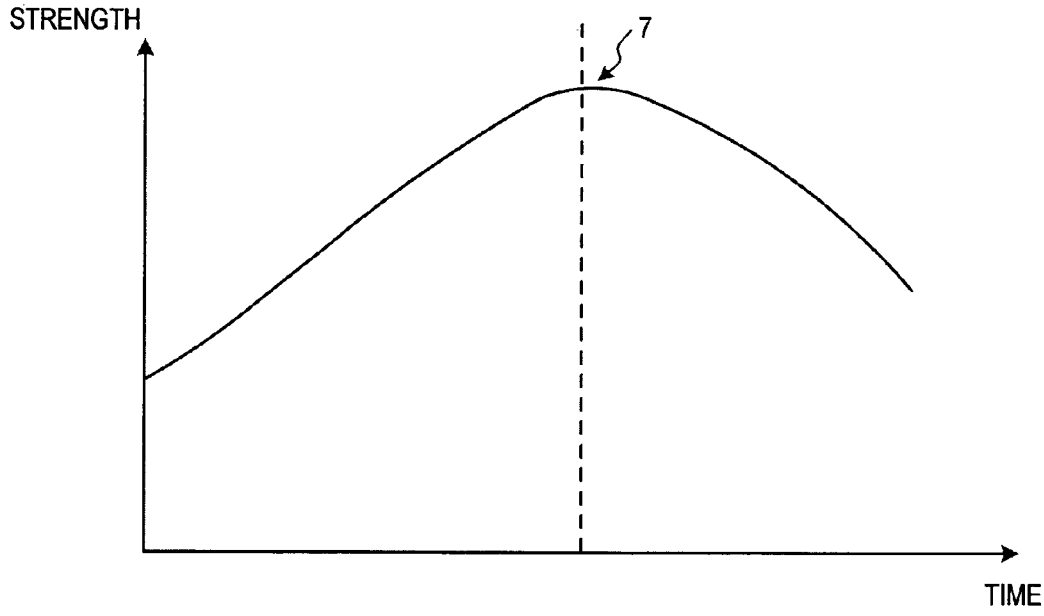
FIG. 2 is a graph showing a relation between time and strength in precipitation-hardening type of aluminum alloy pipe of high hardness.

A strength of the pipe material 13 can reach a peak strength 7 in a graph shown in a relation between time and strength in FIG. 2 by properly setting time for the artificial aging process 3.

Figure 3:
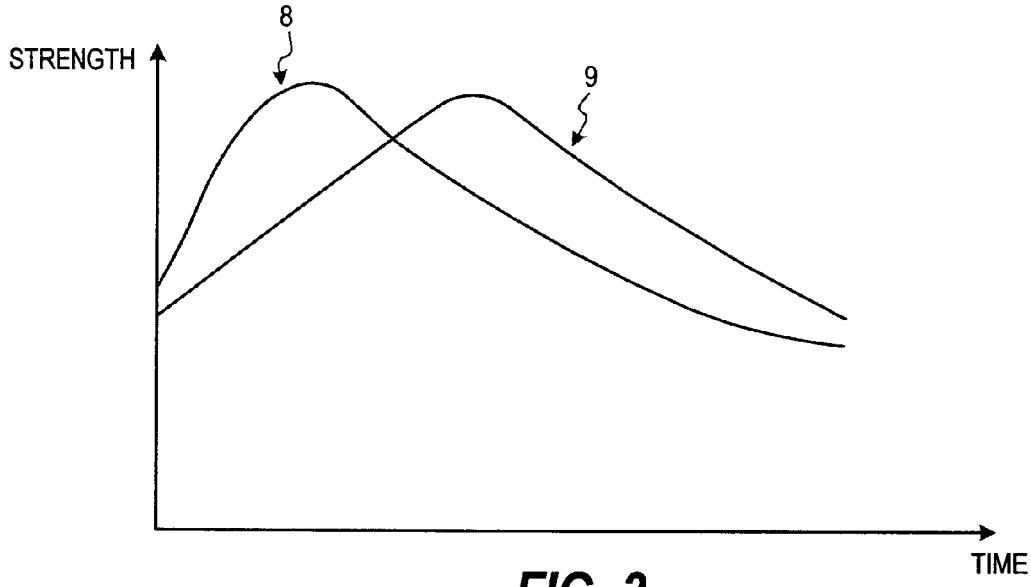
FIG. 3 is a graph showing a relation between time and strength in precipitation-hardening type of aluminum alloy pipe of high hardness in a case where distortions are produced.

As shown in FIG. 3, a wave shape (property) showing a relation between aging treatment time and strength differs in a case 8 where inner distortions in the pipe material 13 are great and a case 9 where inner distortions in the pipe material 13 are small.

This is because as the distortions become greater, precipitation of a precipitation element (MgZn2 or the like in the case of A7000 family aluminum alloy) inside the pipe material 13 is produced faster. Portions in the pipe material 13 where the spinning process is greatly performed produce more inner distortions therein, which shortens the reach time to the peak strength. To the contrary, portions in the pipe material 13 where the spinning process is a little performed produce less inner distortions therein, which requires the more reach time to the peak strength, as compared to the portions in the pipe material 13 where the spinning process is greatly performed.

Accordingly, in a case where the artificial aging is performed until the portions with small distortions reach the maximum strength in time, the portions with great distortions (namely, thin portion in thickness) are already in an excessive aging state over the maximum strength, being low in strength and the extension thereof becomes great as a result of the lowered strength.

Figure 4:
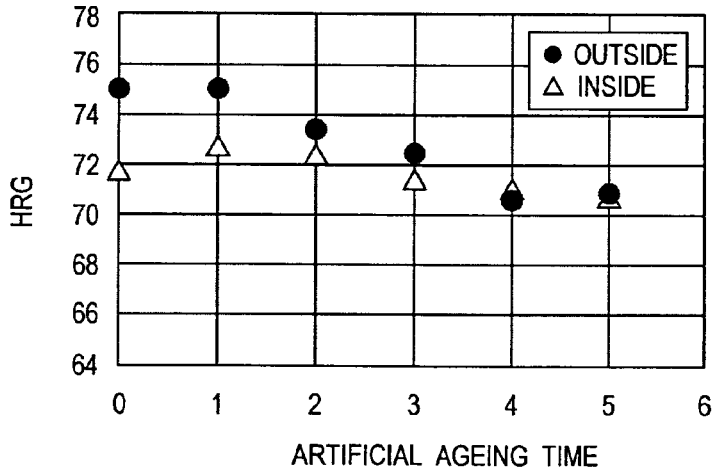
FIG. 4 is a table showing a relation between artificial aging time and hardening.

According to the spinning work, distortions on an outer face of the pipe material 13 in contact with the roller 12 become great. Therefore, as shown in FIG. 4, after the spinning work ends, the vicinity of the outer side face of the pipe material 13 is hardened. However, as the artificial aging is advanced, the aging is advanced faster in the outer side face with high transfer density, which produces the excessive aging to lower the hardening of the outer side face. On the other hand, the aging is advanced slower in the inside of the pipe material 13 and therefore, a change in the hardening thereof is small.

According to the present invention, hardness in the outer side face and the inside of the pipe material 13 can be nearly even. The outer side face of the pipe material 13 is in contact with an atmosphere, so that a stress corrosion crack tends to be produced. In this case the outer side face of the pipe material 13 can be in an excessive aging state, thus enabling the aluminum pipe of high strength to be manufactured.

According to the present invention as described above, since the spinning work is performed after the solution process, an inexpensive material of high strength can be manufactured with work hardening. And time for the artificial aging can be shortened, thereby reducing expenses for heat treatment.

Figure 6:
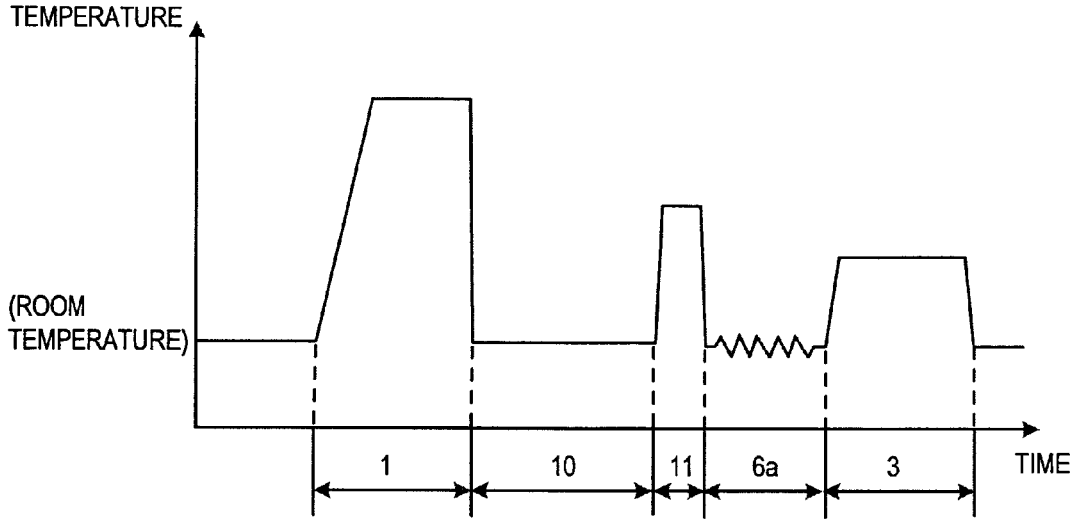
FIG. 6 is an explanatory view showing a method of manufacturing an aluminum alloy pipe in a second preferred embodiment of the present invention.

FIG. 6 shows a method of manufacturing an aluminum alloy pipe in a second preferred embodiment of the present invention.

This embodiment differs from the first preferred embodiment in that the spinning work process 6*a* is not performed for the pipe material 13 immediately after the solution process 1 thereto has ended. That is, after the solution process, the natural aging process 10 for leaving the pipe material 13 placed at a room temperature is performed, further the reversion process 11 is performed to reheat the pipe material 13 and thereafter, the spinning work process 6*a* is performed.

The reason for the above order of the processes is that material producers are usually different from process performers and therefore, it is difficult to process the material immediately after the solution treatment is performed. The material for which the solution treatment has ended is obtained from a material producer and is stored in a warehouse for exposure to air. Thus the material in which the natural aging is advanced and the plastic working property deteriorates is subjected to the reversion treatment for reheating, thereby improving the plastic working property in the spinning work.

Figure 7:
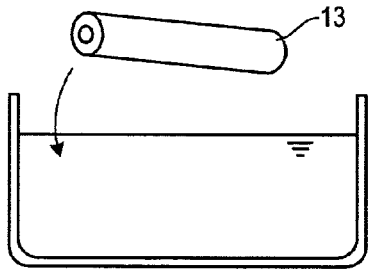
FIG. 7 is an explanatory view showing a reversion process in the second preferred embodiment.

It is preferable to set temperatures in the range of 150° C.-250° C. as an optimum value of a heat temperature in the reversion process 11. Further, in order to speed up a rise in temperature, as shown in FIG. 7, it is preferable to adopt a method where the pipe material 13 is immersed in an oil having temperatures in the range of 150° C.-300° C. or an induction heat method (not shown).

The spinning work process 6*a* as one of plastic working is performed after the reversion process 11 has ended. And the material for which the spinning work process 6*a* has ended is moved to the artificial aging process 3.

The spinning work process 6*a* and the artificial aging 3 are the same as in the first preferred embodiment. Therefore, the explanation for them is omitted.

Figure 8:
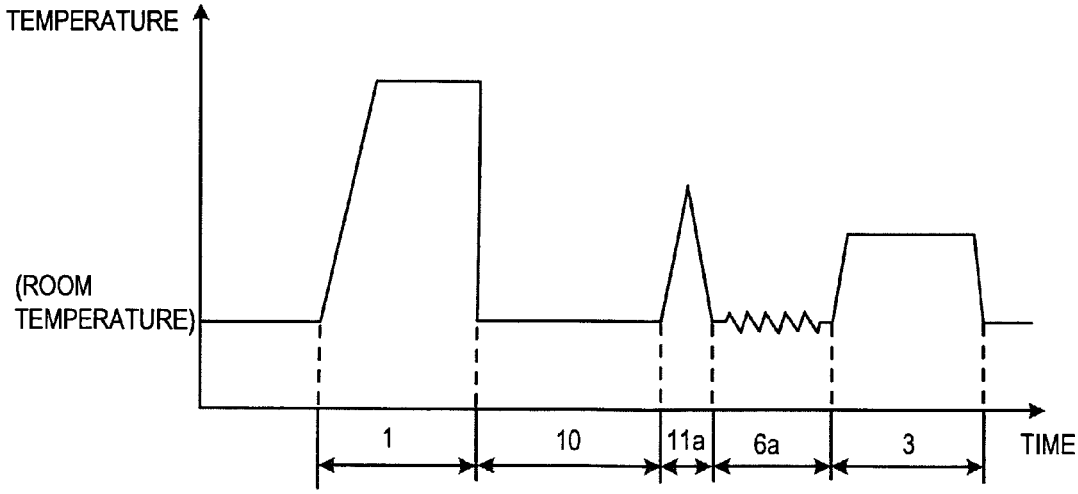
FIG. 8 is an explanatory view showing a method of manufacturing an aluminum alloy pipe in a third preferred embodiment of the present invention.

FIG. 8 is an explanatory view showing an aluminum alloy pipe in a third preferred embodiment of the present invention.

This third preferred embodiment differs from the second preferred embodiment in the reversion process performed after the natural aging process 10. That is, the third preferred embodiment adopts a reversion process 11*a* having a rise and a descend in temperature with a certain characteristic.

Figure 9:
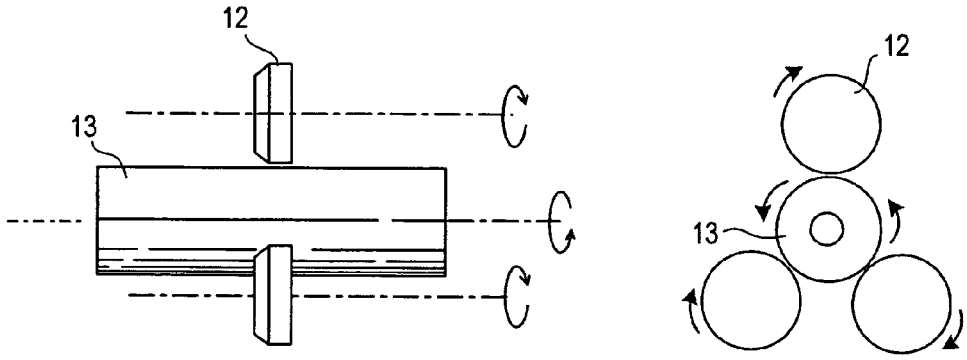
FIG. 9 is an explanatory view showing a reversion process in the third preferred embodiment.
Figure 10:
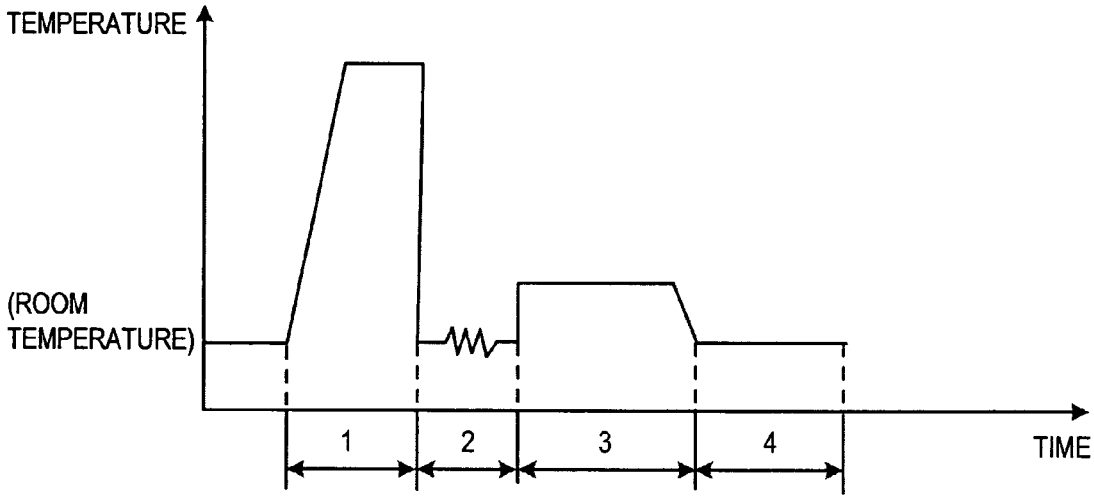
FIG. 10 PRIOR ART
FIG. 10 is an explanatory view showing a method of manufacturing a conventional aluminum alloy pipe.
Figure 11:
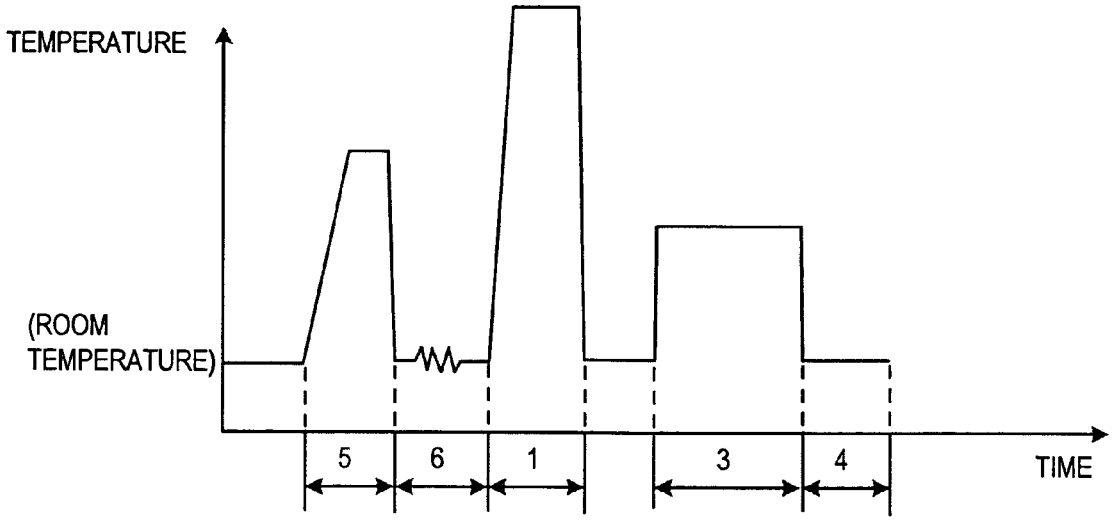
FIG. 11 PRIOR ART
FIG. 11 is an explanatory view showing another example with respect to a method of manufacturing a conventional aluminum alloy pipe.

FIG. 9 is an explanatory view showing a detail of the reversion process 11*a*.

In the reversion process 11*a*, heat generation caused by friction between the roller 12 and the pipe material 13 during the spinning work and heat generation caused by plastic deformation of the pipe material 13 are used. In this case, in order to enhance an effect of a temperature rise a coolant is not used (namely, cooling is not performed) and a rotation speed of the main shaft is increased more than in the spinning work process 6*a*, thus rapidly heating the pipe material 13 locally. For example, in the case of reversion for the pipe material 13 having a length of several ten centimeters, the spinning work is performed for several ten seconds.

This enables the temperature to increase and decrease for a short time due to high heat conductivity of aluminum material. In this case the plastic working property can improve even for the pipe material 13 in which the natural aging (room temperature aging) is advanced. As a result, in the spinning work process 6*a* to be performed immediately thereafter (after a few seconds—several ten seconds), the spinning work with high work property can be easily performed.

Since the heating time is long in the reversion process 11 in the second preferred embodiment using an oil bath or the like, the cooling treatment is necessary after heating. In the reversion process 11 of the third preferred embodiment, the heat is locally generated and the heat amount is small, so that self-cooling is sufficient for cooling the material.

Further, in the spinning work process 6*a*, a coolant is sprayed from the both sides of the roller 12 for cooling as described above. Therefore, even in a case where the self-cooling is not sufficient in the reversion process 11*a*, when this cooling method by the coolant is used, a sufficient cooling effect can be obtained through the spinning work process 6*a* to be performed immediately after the reversion process 11*a*.

Accordingly, since the reversion treatment is thus performed by the spinning work, it is not necessary to use the oil bath or the induction heating unlike the conventional method, thereby improving safety and reducing the cost in the manufacture.

It is obvious that various modifications of preferred embodiments can be achieved within the scope of the spirit of the present invention. In the above preferred embodiments, an A7000 family aluminum alloy is explained as one example of precipitation-hardening type of aluminum alloys of high hardness, but the present invention is not limited to it.

And so long as the artificial aging time is more than the maximum-strength reach time of the portion with the smallest distortions, since portions in relation to all strength ranges corresponding to the magnitude of the distortions generated in the material can be placed in an excessive aging, it is possible to increase an extension amount of the material and improve an stress corrosion crack resistance.

Note that in the present invention, both processes of the reversion process and the plastic working process are performed through the spinning work process, but in the present invention only the reversion process can be performed by the spinning work process as an alternative of the conventional method. In this case, in the reversion treatment process, heat generation caused by friction between the roller and the material and heat generation caused by material deformation by spinning work are adjusted based upon main shaft rotation speeds, as well as the material is locally heated without cooling.

What is claimed is:

1. A method of manufacturing an aluminum alloy of high strength, comprising the steps of:

forming a pipe material by extruding a precipitation-hardening aluminum alloy of high hardness;

performing a solution treatment upon the pipe material by heating the pipe material to a temperature within a first range;

naturally aging the solution treated pipe material at room temperature;

performing a reversion treatment upon the naturally-aged pipe material by heating the pipe material at a temperature within the range of 150° C.-250° C., the reversion treatment being performed by a first spinning work treatment in which a roller is pressed on an outer periphery of the pipe material while the pipe material is rotated;

performing a second spinning work treatment as one of plastic working upon the reversion-treated pipe material by pressing the roller on the outer periphery of the pipe material while the pipe material is rotated; and artificially aging the second spinning-work treated pipe material by heating the pipe material to a temperature within a second range lower than the first range.

2. The method according to claim 1, wherein:

the reversion treatment step includes simultaneously locally heating the pipe material with heat generated by friction between the roller and the pipe material and heat generated by deformation of the pipe material while the pipe material is rotated in the absence of a coolant; and adjusting the amount of local heating of the pipe by varying rotational speeds of a main shaft that rotates the pipe material.

3. The method of claim 1, wherein, during the reversion treatment, the naturally-aged pipe material is heated from the room temperature to the temperature within the range of 150° C.-250° C. by friction heat between the roller and the pipe material and heat generated by deformation of the pipe material, without being heated by a heat source.

4. A method of manufacturing an aluminum alloy of high strength, comprising the steps of:

forming a pipe material by extruding a precipitation-hardening aluminum alloy of high hardness;

performing a solution treatment upon the pipe material by heating the pipe material to a temperature within a first range;

naturally aging the solution treated pipe material at room temperature;

performing a first spinning work treatment upon the naturally-aged pipe material so as to reheat the pipe material at a temperature within the range of 150° C.-250° C., the first spinning work treatment being performed by pressing a roller on an outer periphery of the pipe material while the pipe material is rotated in a first rotation speed;

performing a second spinning work treatment as one of plastic working upon the reheated pipe material by pressing the roller on the outer periphery of the pipe material while the pipe material is rotated in a second rotation speed slower than the first rotation speed; and artificially aging the second spinning-work treated pipe material by heating the pipe material to a temperature within a second range lower than the first range.

5. The method of claim 4, wherein the second spinning work treatment includes spraying a coolant from both sides of the roller, and no coolant is sprayed during the first spinning work treatment.

6. The method of claim 4, wherein, the naturally-aged pipe material is reheated from the room temperature to the temperature within the range of 150° C.-250° C. by friction heat between the roller and the pipe material and heat generated by deformation of the pipe material, without being heated by a heat source.

* * * * *